US005602624A

United States Patent [19]

Coburn et al.

[11] Patent Number: 5,602,624

[45] Date of Patent: Feb. 11, 1997

[54] APPARATUS FOR ADDING COLOR INDICIA TO PRINTED DOCUMENTS

[75] Inventors: Richard J. Coburn, Bloomfield; Stefan G. Golicz, Essex, both of Conn.; Norman L. Milliard, Hampton, N.H.

[73] Assignee: Accent Color Sciences, Inc., East Hartford, Conn.

[21] Appl. No.: 334,192

[22] Filed: Nov. 4, 1994

[51] Int. Cl.[6] ..... G03G 21/00

[52] U.S. Cl. ..... 347/2; 346/138; 399/1

[58] Field of Search ..... 355/202, 326 R, 355/327, 328, 244; 346/138

[56] References Cited

U.S. PATENT DOCUMENTS 4,373,799 2/1983 Snelling et al. ..... 365/202
4,810,604 3/1989 Schmidlin ..... 355/328 X
5,241,341 8/1993 Okauchi et al. ..... 355/202
5,321,467 6/1994 Tanaka et al. ..... 355/202
5,373,350 12/1994 Taylor et al. ..... 355/202

*Primary Examiner*—William J. Royer
*Attorney, Agent, or Firm*—Chilton, Alix & Van Kirk

[57] ABSTRACT

A printer for adding accent colors to preprinted documents includes a transport which defines a curvilinear path along which the documents move during the printing of the accent colors thereon. The printing is accomplished through the use of multiple print heads which discharge wax based ink through multiple jets. The documents to which the accent colors are to be added are edge justified and then released in timed sequence to the curved transport path which leads through a printing zone defined by the print heads.

16 Claims, 15 Drawing Sheets

APPARATUS FOR ADDING COLOR INDICIA TO PRINTED DOCUMENTS

BACKGROUND OF THE INVENTION

1. Field of the Invention

The present invention relates to the processing of printed documents and, particularly, to the addition of indicia comprising one or more colors to previously printed black on white documents. More specifically, this invention is directed to a document processing system having a single paper path and the capability of being interfaced with a high speed monocolor printer and, especially, to apparatus employing multiple print heads to add colored indicia to documents exiting an interfaced printer without reducing document throughput rate or requiring redirection of the documents exiting the interfaced printer into multiple processing paths. Accordingly, the general objects of the present invention are to provide novel and improved methods and apparatus of such character.

2. Description of the Prior Art

While not limited thereto in its utility, the present invention enables the addition of indicia, in selected colors, to printed documents exiting a high speed electrographic or xerographic printer, i.e., in a preferred embodiment the present invention is a high volume printer with accent color capability. There has been a long standing and unmet need in the art of the ability to provide color enhancement to conventional black on white printed documents. Previous attempts to satisfy this demand, as will be briefly described below, have been unsatisfactory in that there has been a failure to address the need to preserve the significant investment of potential users in their existing, installed black print data printers and, particularly, to recognize that this investment has been made with a primary objective of increasing printing speed.

As an example of the prior art attempts to achieve high volume printing with multiple color capability, two color printing capability has recently been added to conventional xerographic apparatus by using two developers, one for black and one for a single accent color, operating at different voltages. This approach, however, has the disadvantage that it cannot offer full spectrum color capability on a high speed data printer.

For users requiring or desiring more than a combination of black plus a single accent color, the only previous alternatives have been low speed systems characterized by high labor intensity and/or expensive investment in equipment. By way of example, a xerographic process employing multiple developers may be employed. Printers utilizing multiple developers are slow, typically five pages per minute maximum, and expensive. Ink jet printer technology also offers multiple color capability. However, the prior art ink jet technology employed water-based inks which imposed restrictions on the choice of paper being processed and, generally, presented problems with permanency as a result of moisture absorption. It is to be noted that ink jet technology is available which employs print media which is liquid in the jet and solidifies upon impact, such media typically being wax based. While the use of wax based inks provides excellent full color range, previously available printers employing this technology are notoriously slow.

SUMMARY OF THE INVENTION

The present invention overcomes the above-briefly discussed and other deficiencies and disadvantages of the prior art by providing a hybrid printer system, and particularly a combination of an electrographic or xerographic printing process, to initially print a document using black toner, and a full spectrum ink jet printer for adding indicia to the black printed document. The ink jet printer system is located immediately downstream of the apparatus for printing the black text and, preferably, is interfaced therewith so as to define a continuous paper path.

Apparatus in accordance with the present invention employs a transport system which reliably and serially moves sheets comprised of various materials, sizes, thicknesses and textures, the documents being processed not necessarily being sequentially identical. This transport system presents the documents in orderly and predictable fashion for further processing. In accordance with a preferred embodiment, this further processing consists of high speed multi-color printing with a wax based ink. However, the transport system of the invention may be employed to deliver documents for imaging, personalization, labelling, etc. and these non-disclosed processing steps may be employed in conjunction with the multi-color printing.

An accent color printing system in accordance with a first embodiment of the present invention is comprised of an infeed module, a justification module, module, a timing module, a placement/bypass, a processing module which includes a rotary transport and associated printers, a selective pick-off module and a discharge module which may include a document stacker or other peripheral equipment.

The justification module of the disclosed embodiment of the present invention comprises a unique conveyor which transports and justifies, either to the left or to the right, sheet material of various size, thickness, texture, porosity, etc. This edge justifying transport conveyor employs at least a first endless belt which is tensioned around two rollers and twisted so that the upper, i.e., outer, face of the belt traveling on one roller becomes the inside face of the belt at the other roller. This arrangement will cause objects delivered to the belt to be moved laterally by a distance of up to the thickness of the belt multiplied by the number of twists between the rollers.

BRIEF DESCRIPTION OF THE DRAWINGS

The present invention may be better understood, and its numerous objects and advantages will become apparent to those skilled in the art, by reference to the accompanying drawings wherein like reference numerals refer to like elements in the several figures and in which.

DESCRIPTION OF THE DISCLOSED EMBODIMENT

Figure 1:
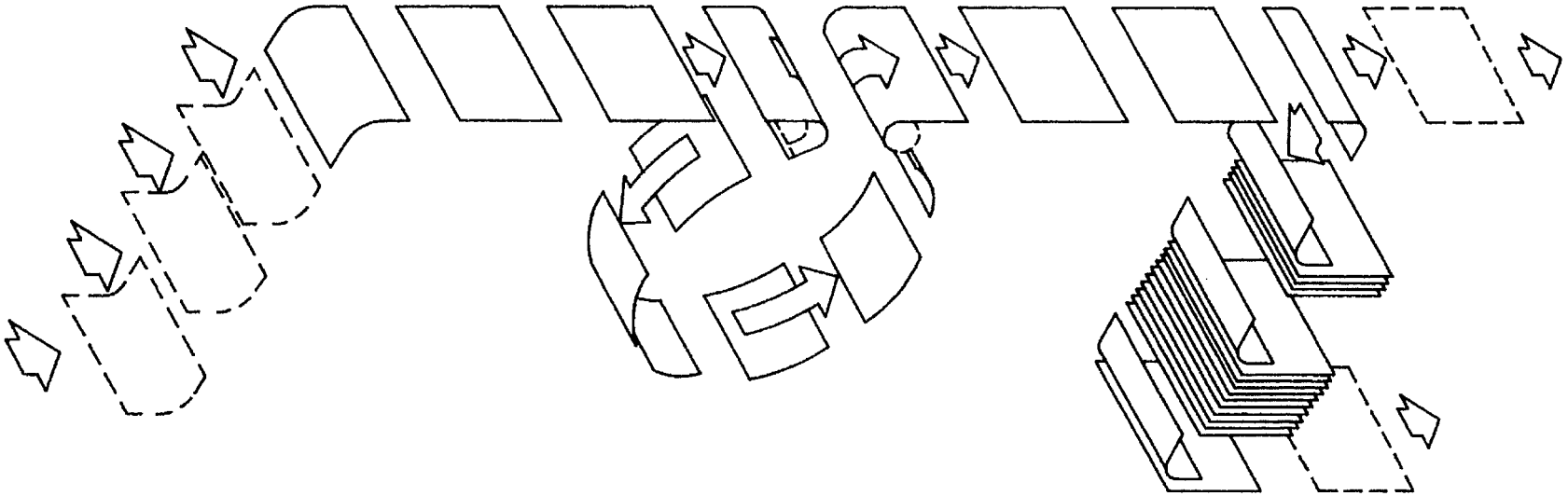
FIG. 1 is a schematic, perspective view which represents the movement of documents being processed in accordance with the present invention.
Figure 2:
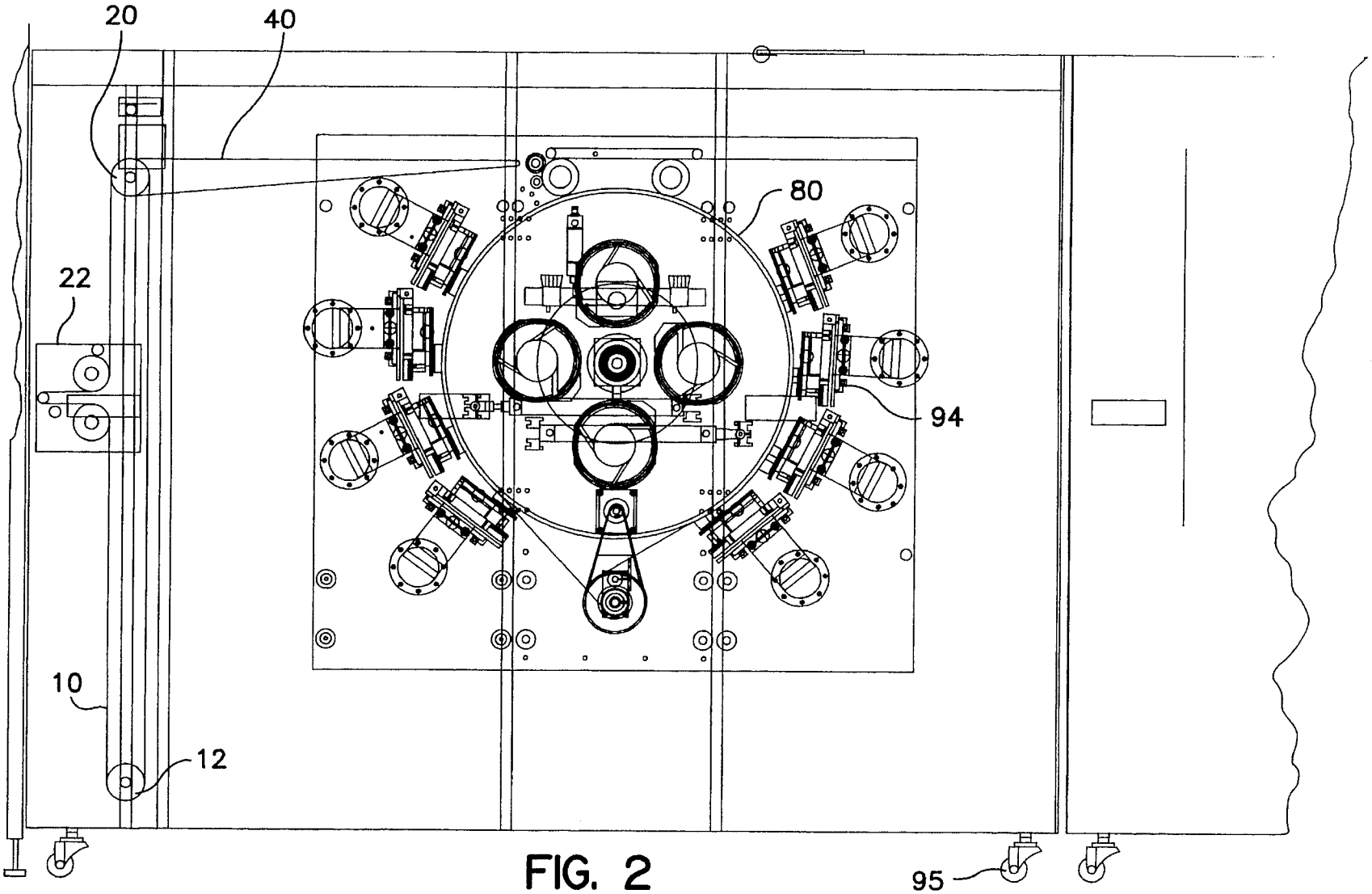
FIG. 2 is a schematic, partial side elevation view of apparatus in accordance with a preferred embodiment of the invention.
Figure 5:
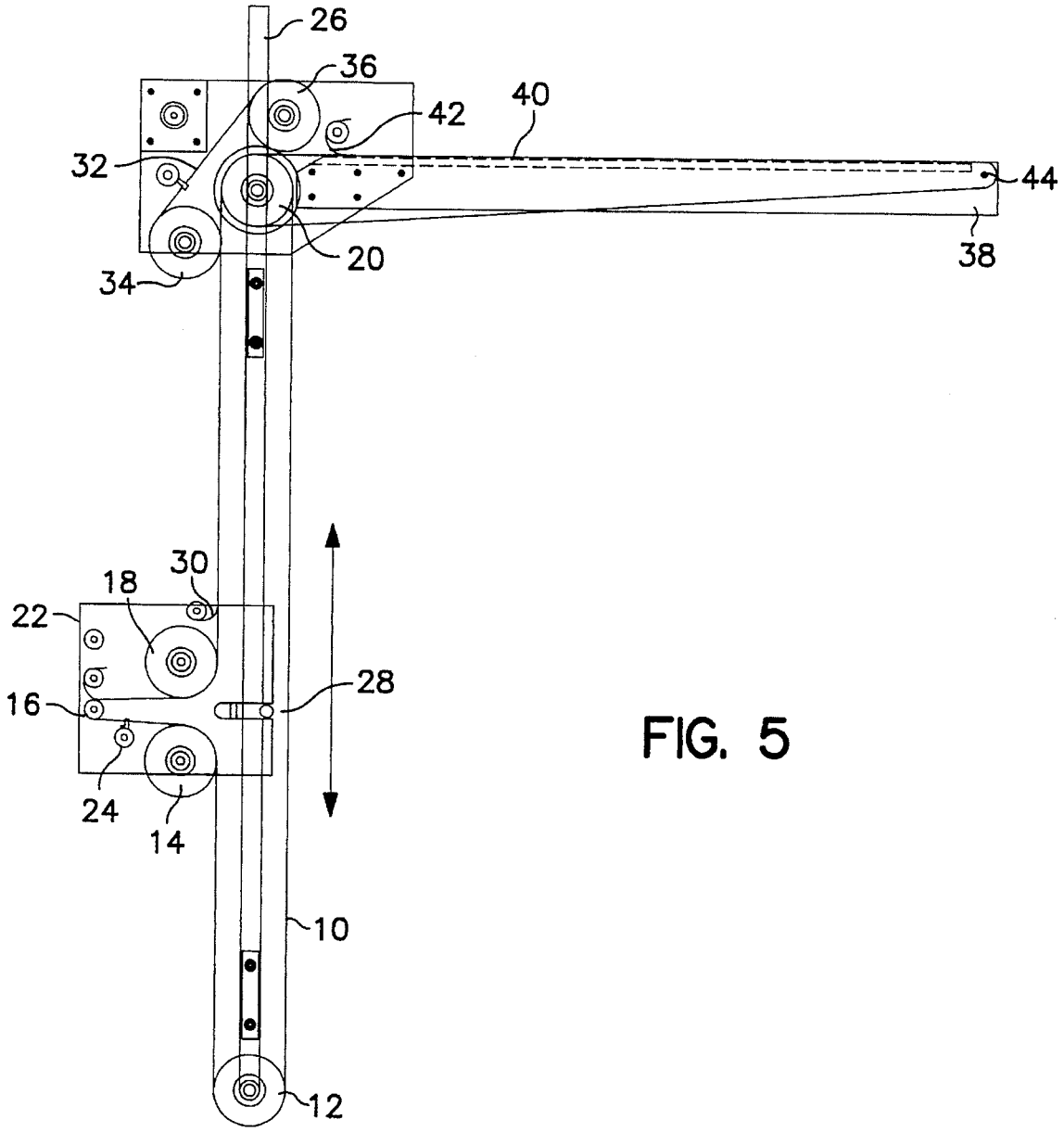
FIG. 5 is an enlarged, side-elevation view of the infeed and justification modules of the apparatus depicted in FIG. 2.

With reference now to the drawings, the infeed module portion of the disclosed embodiment is designed to interface with, or otherwise be directly coupled to, the discharge port of an existing high speed, black toner printer. Accordingly, the level at which the incoming printed documents are received may be adjusted vertically to permit interfacing of the invention with various hosts. The infeed module is also designed to accept incoming material regardless of form, i.e., the present invention may be employed to process material in sheet or more complex forms such as envelopes, pockets, etc. The incoming documents are received on the upper side of a horizontal run of a conveyor belt 10 at the level of a vertically adjustable platform 22. Belt 10, as may be seen from FIGS. 2 and 5, is continuous and passes about rollers 12, 14, 16, 18 and 20. The axles which support rollers 12 and 20 are fixed in position on the machine frame while rollers 14, 16 and 18 are mounted on platform 22 which also includes a belt guide 24. Platform 22 may be slid along a vertical frame member 26 and locked at the desired vertical level by means of a clamp collar 28. Referring jointly to FIGS. 1 and 5, a document received on belt 10 will, while travelling on the belt, pass under roller 18 where its direction of motion is changed, i.e., the document travel path will change from horizontal to vertical. The document then moves upwardly and, during such movement is held against belt 10 by spring-loaded fingers such as the finger indicated schematically at 30. When the document reaches the desired height as defined by the outer diameter of roller 20, its direction is again changed such that it resumes movement in a generally horizonal direction, albeit at a higher level than the initial infeed level. The change of direction at the top of the infeed module, in the disclosed embodiment, is accomplished by causing the document to be transported around roller 20 while being sandwiched between a further continuous belt 32, which passes around rollers 34 and 36, and belt 10. The change in direction must be accomplished in such a manner, i.e., the diameter of roller 20 must be sufficiently great, to ensure that a permanent curl will not be imparted to the document. The infeed module conveyor belt 10 and belt 32 will typically be comprised of plural parallel belts.

Documents discharged from the infeed module are received by a justification module. The justification module, which in part straddles the primary processing module, ensures that one edge the incoming document is in contact with a linear guide rail 38 which extends in the direction of document travel. This document justification is necessary to ensure precise positioning of the document. As will be obvious, since the second and further colors are to be added to a document which has already been printed, the document must be positioned such that the areas where the color printing is to be added will be located with exactness. In accordance with the disclosed embodiment of the invention, the justification module includes at least a first twisted elastomeric belt 40 which, at the upstream end in the direction of document motion, passes about roller 20, i.e., the belt or belts 40 of the justification module will, at roller 20, be interleaved with the individual belts defining the infeed module conveyor belt 10. Documents will be held against belt(s) 40 by means of spring fingers such as finger 42.

Figure 6A:
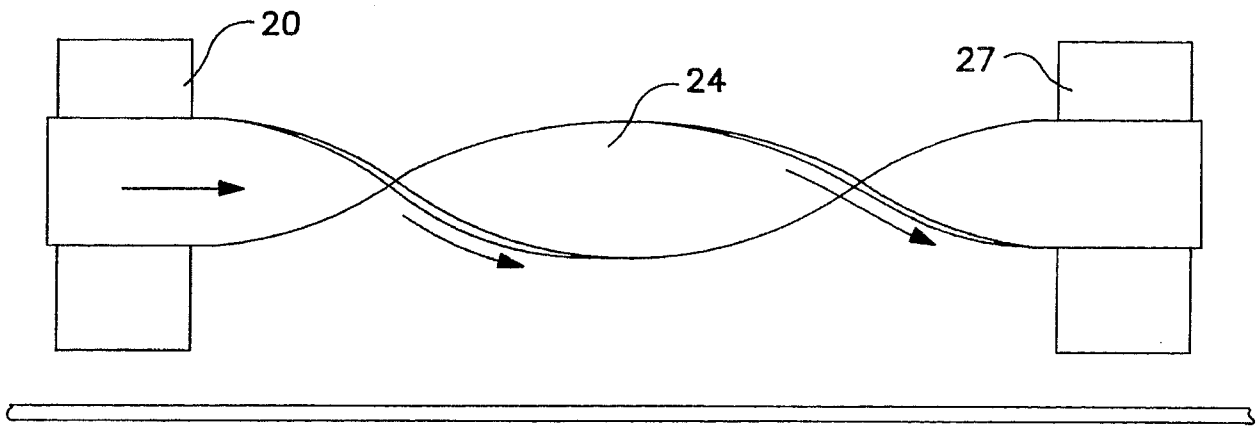
FIGS. 6A and 6B are, respectively, top and side elevation views which explain the operation of the justification module shown in FIGS. 2 and 5.
Figure 6B:
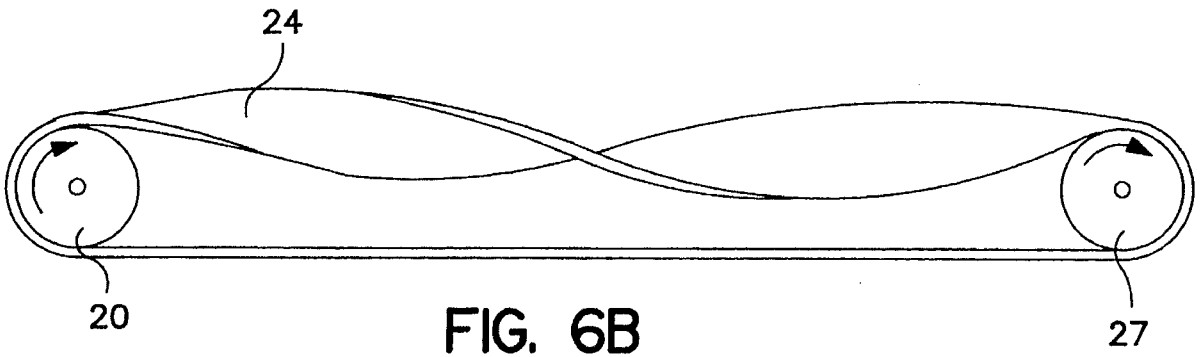

The function and construction of the justification module may be better understood by reference to FIGS. 5, 6A and 6B. The justification module is, in effect, an edge justifying transport conveyor which simultaneously transports and edge justifies, either to the left or to the right, sheets of material of various sizes, thickness, textures, porosity, etc. While the edge justifying transport conveyor is primarily used in the disclosed hybrid printing system for positioning single sheets of paper, it may be employed for folded sheets, multiple sheets, or formed sheets such as, for example, envelopes or flattened cartons. The edge justifying transport conveyor assures that the "documents" being moved will follow a linear trajectory which is referenced to one edge of the document. The edge justifying transport conveyor of the present invention is characterized by the ability to position the documents being processed as necessary for further processing with the minimum number of components and the shortest possible distance and, most importantly, while retaining constant linear speed.

The endless belt 40 may, for example, be ⅜ inches wide and is tensioned by passing around roller 20 and a downstream roller 44. The belt 40 is twisted in such a manner as to have a first face, i.e., an outside face, traveling on one roller which becomes the inside face at the other roller. Thus, the left edge of the belt at roller 20 will become the right edge of the belt at roller 44 assuming a single twist, or odd number of twists. Even numbers of twists will result in the left edge of the belt on roller 20 returning to the left edge on the belt on roller 27. The result of the twists is that the belt rotates along an axis between roller 20 and roller 27, in increments of 180 degrees depending on the number of twists. Thus, any object in contact with the left side of the belt at roller 20 will be moved ⅜ inches to the right, or against a guide rail if the initial spacing between the object and the guide rail is less than ⅜ inches, by the time it reaches roller 44. By inducing more than one twist to the belt, the side movement of the object being transported can be multiplied within the same distance of travel. If a multiplicity of such twisted belts are disposed next and parallel to each other with an identical number of twists, objects having any size/weight can be transported with simultaneous movement to either the left or the right depending on the direction of the twist given to the belts. To ensure controlled justification to one side, a guide rail or the like oriented parallel to the desired travel direction will be employed. A document coming into contact with the guide rail will be unable to move further in the transverse direction and thus will continue its forward trajectory by sliding along the guide rail. If a plurality of belts with opposite twists are placed next to each other, side-by-side, objects such as slit pages placed onto the edge justifying conveyor will either diverge or converge depending on the direction of the twist and at a rate depending on the number of twists.

Apparatus in accordance with the present invention may, but the disclosed embodiment does not, employ a buffer/feeder module which receives the edge-justified, randomly spaced incoming documents and thus acts as an extension of the justification module. The buffer/feeder module, if present, functions in conjunction with the timing module, which will be described below, to receive, store and either feed or pass through the incoming documents in the identical sequence as received. In the interest of facilitating understanding of the invention, the buffer/feeder module has not been shown.

Figure 3:
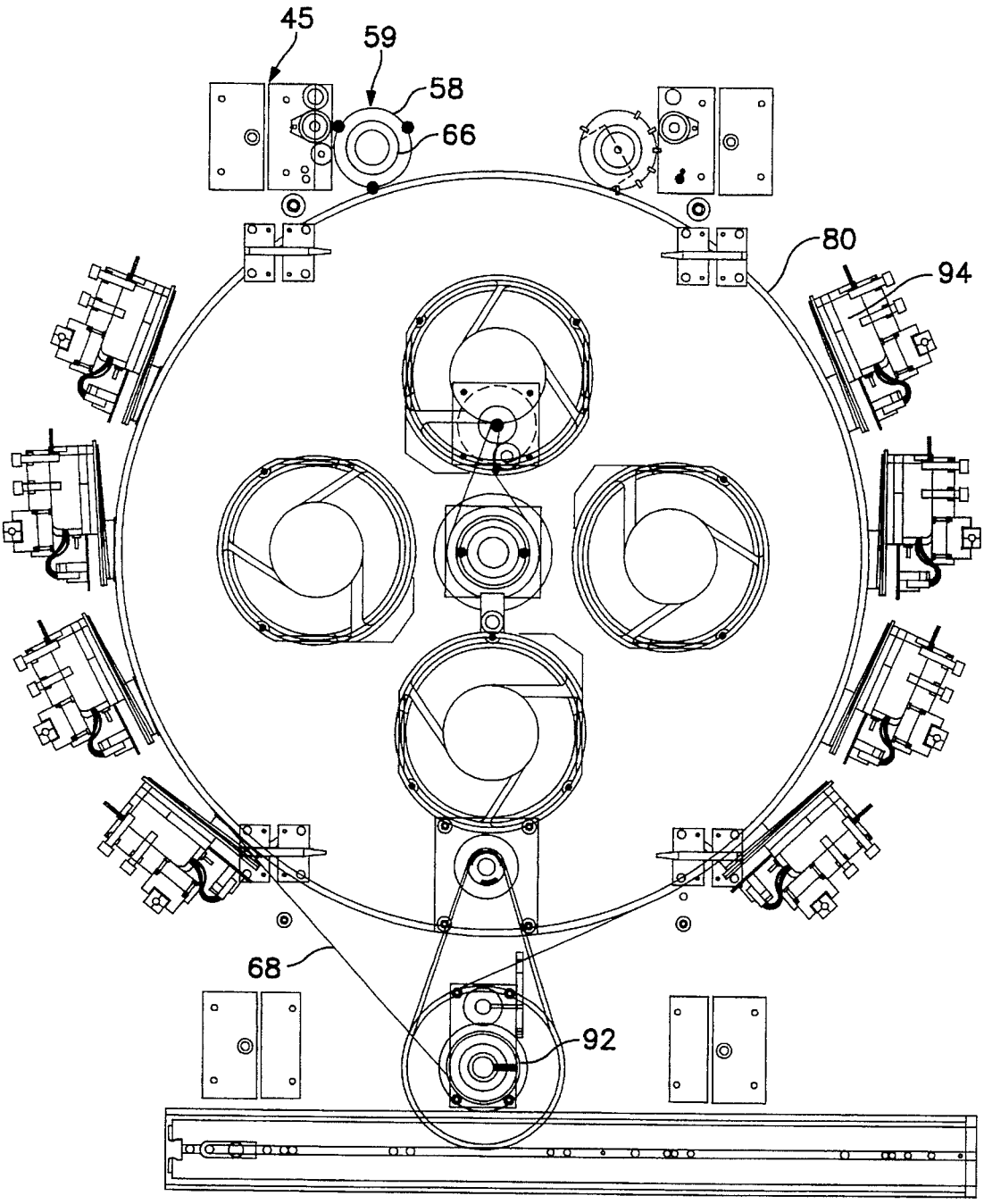
FIG. 3 is a schematic, side elevation view, on an enlarged scale, of a portion of the appartus depicted in FIG. 2.
Figure 4:
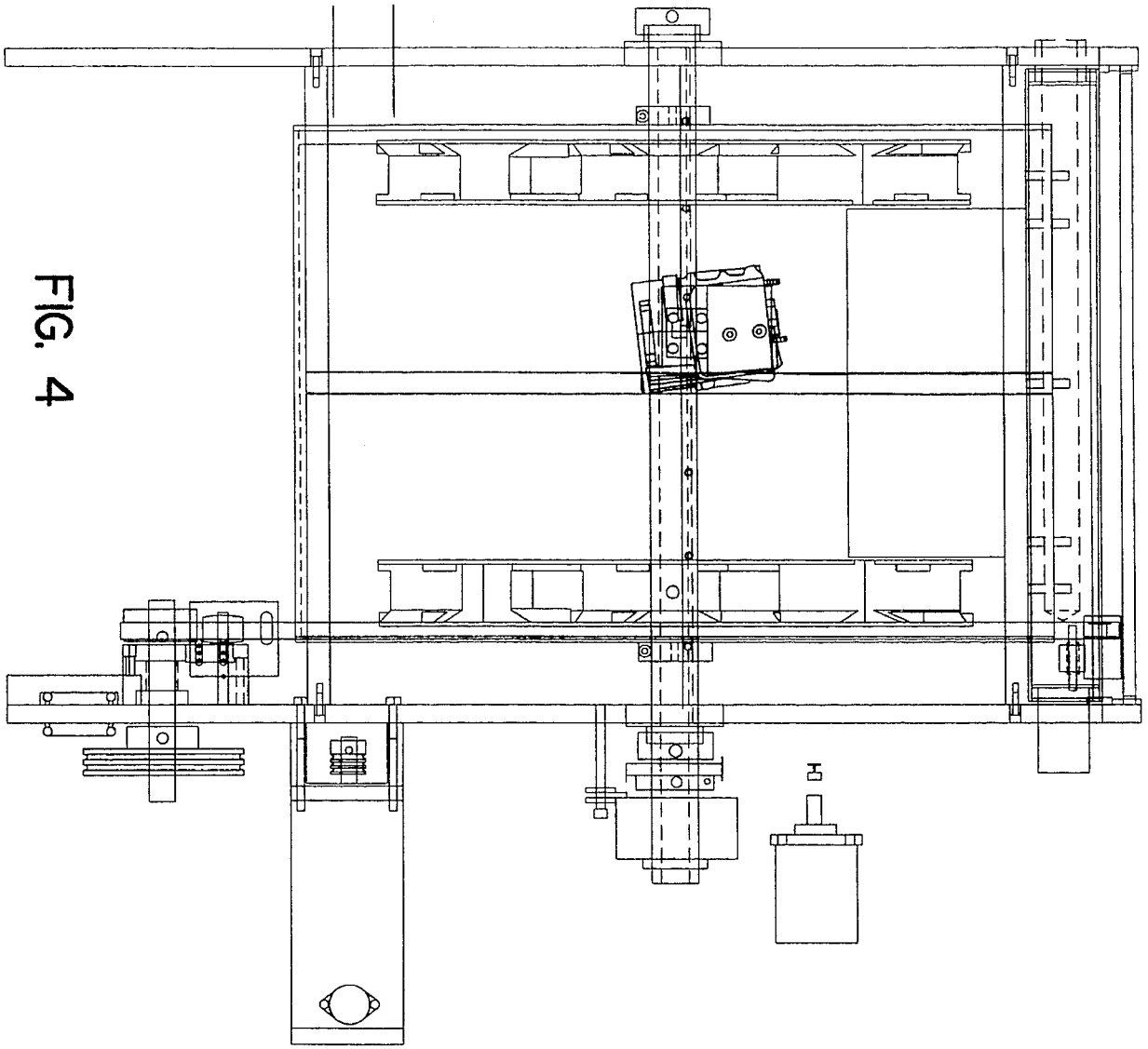
FIG. 4 is a top plan view, taken along line 4—4 of FIG. 3.

The timing module 45 of the disclosed embodiment of the invention, as may be seen from FIG. 3, comprises a pair of rollers 46, 48. The function of the timing module is to receive a side justified document and to ensure that the leading edge of the document is oriented parallel with respect to the axis of rotation of the transport drum of the processing module. The squaring and registering of the leading edge of the side justified document results from the document being stopped at the nip of rollers 46,48. The roller 46 is comprised of an elastomeric material and is activated on command, and in sychronism with the movement of the transport of the processing module, so as to release documents to the immediately downstream placement/bypass module. Roller 46 is a clutch nip roller mounted on a journaled shaft. Roller 46 is driven by a jack roller 52 which is biased, by means of a spring 54, so as to be in contact with both of roller 46 and the drive roller 56 of the porous vacuum roller 58 (see FIG. 3) of the placement/bypass module 59. The idler roller 48, which is of solid construction, is resiliently biased against roller 46, by means of a spring 60. Roller 48 thus functions as a spring loaded pinch bearing. The timing module further includes infeed guides, not shown, which assure that a document is retained within the pitch point, i.e., the point of contact between the idler roller 48 and the cooperating elastomeric roller 46. The pressure applied to roller 48 may be adjusted to ensure that the pinch bearing will press into the elastomeric roller thus reliably defining the pinch point and permitting fine adjustment of the parallelism of the document leading edge and the processing module drum axis of rotation.

Figure 8:
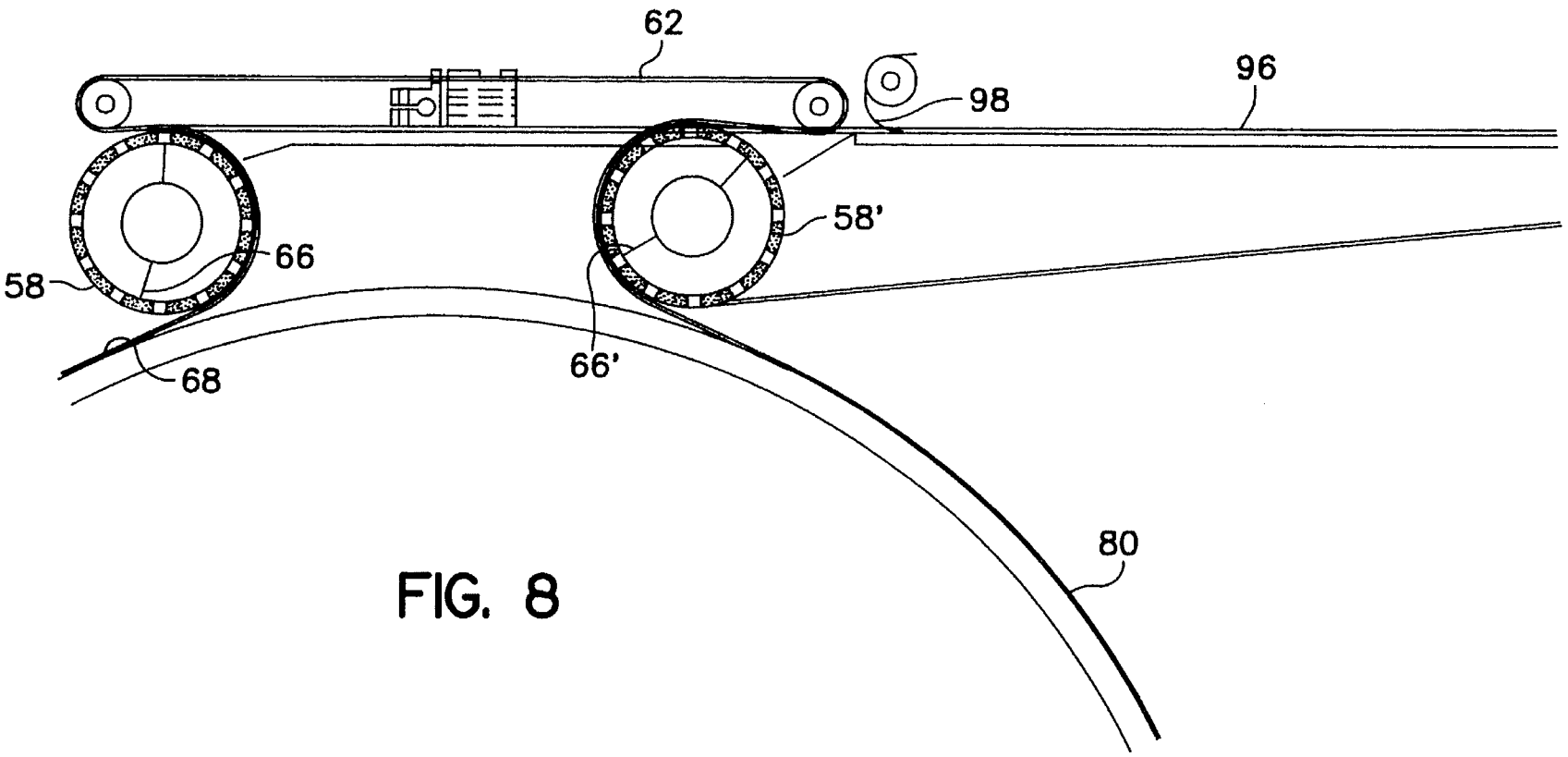
FIG. 8 is a schematic showing, in the form of a side elevation view, of the placement/bypass module of the disclosed embodiment of the invention, the placement/bypass module also being shown in FIG. 3.
Figure 10:
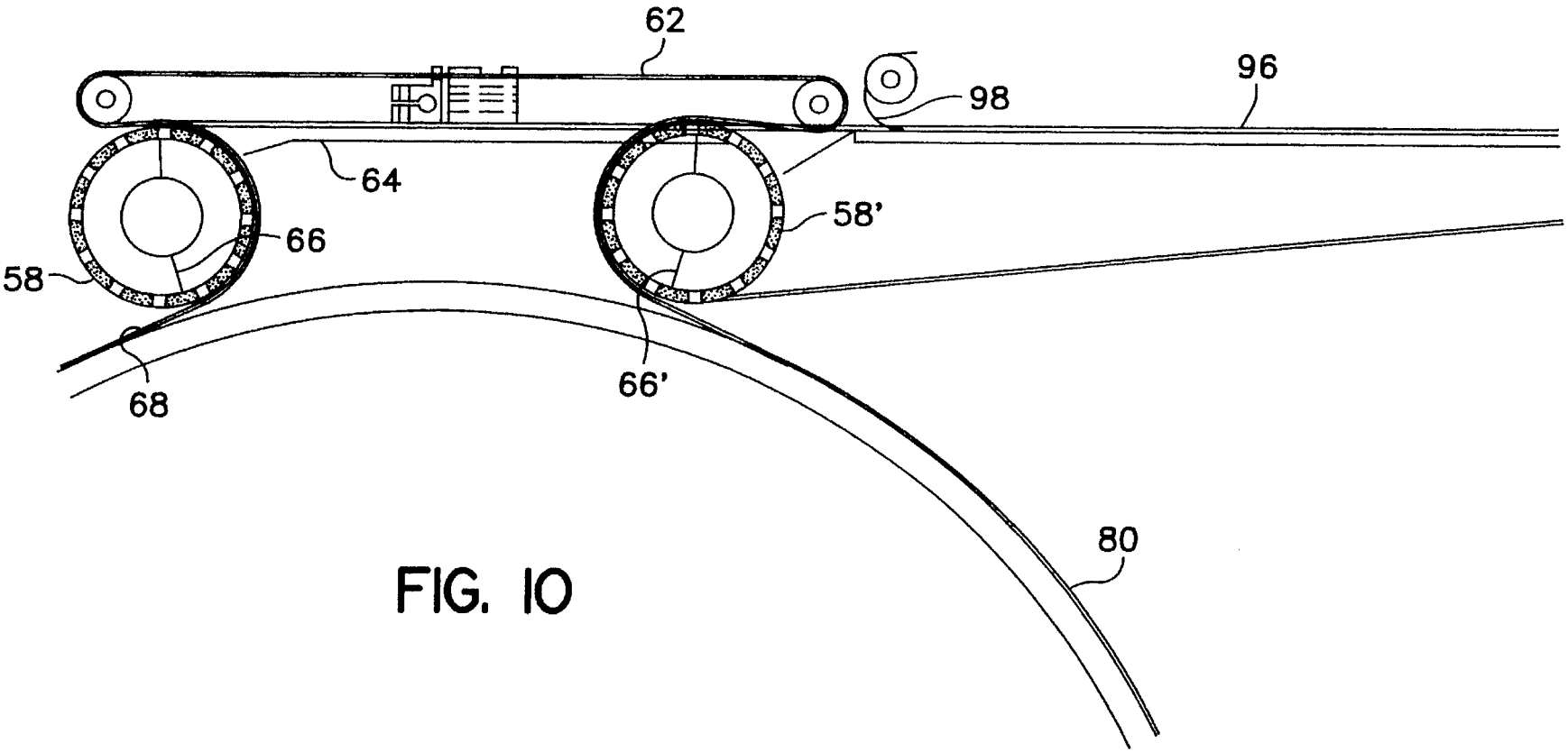
FIG. 10 is a view similar to FIG. 8 which explains operation of the vacuum roller of FIG. 9.

The placement/bypass module is located immediately downstream of the timing module. The purpose of the placement/bypass module is to selectively change the travel path of the incoming document, which will be received in a face down orientation, from linear to rotary. Additionally, if the document is to be passed-through with color accent printing, the placement/bypass module also positions the document, face-up, at a predetermined location on the outer, peripheral surface of the transport drum of the processing module. The conveyor which selectively allows documents to pass over the processing module, i.e., the means for transporting documents which are not to have their travel path changed from linear to rotary, is indicated in FIGS. 8 and 10 at 62. Bypassed documents, i.e., documents which are not engaged and deflected by the placement/bypass module in the manner to be described below, will pass over the vacuum roller 58 of the placement/bypass module onto a bypass skate 64 (see FIG. 10). Documents fed onto skate 64 will be pinched between the skate and the belt of conveyor 62 and will thus be transported in the downstream direction.

Figure 7:
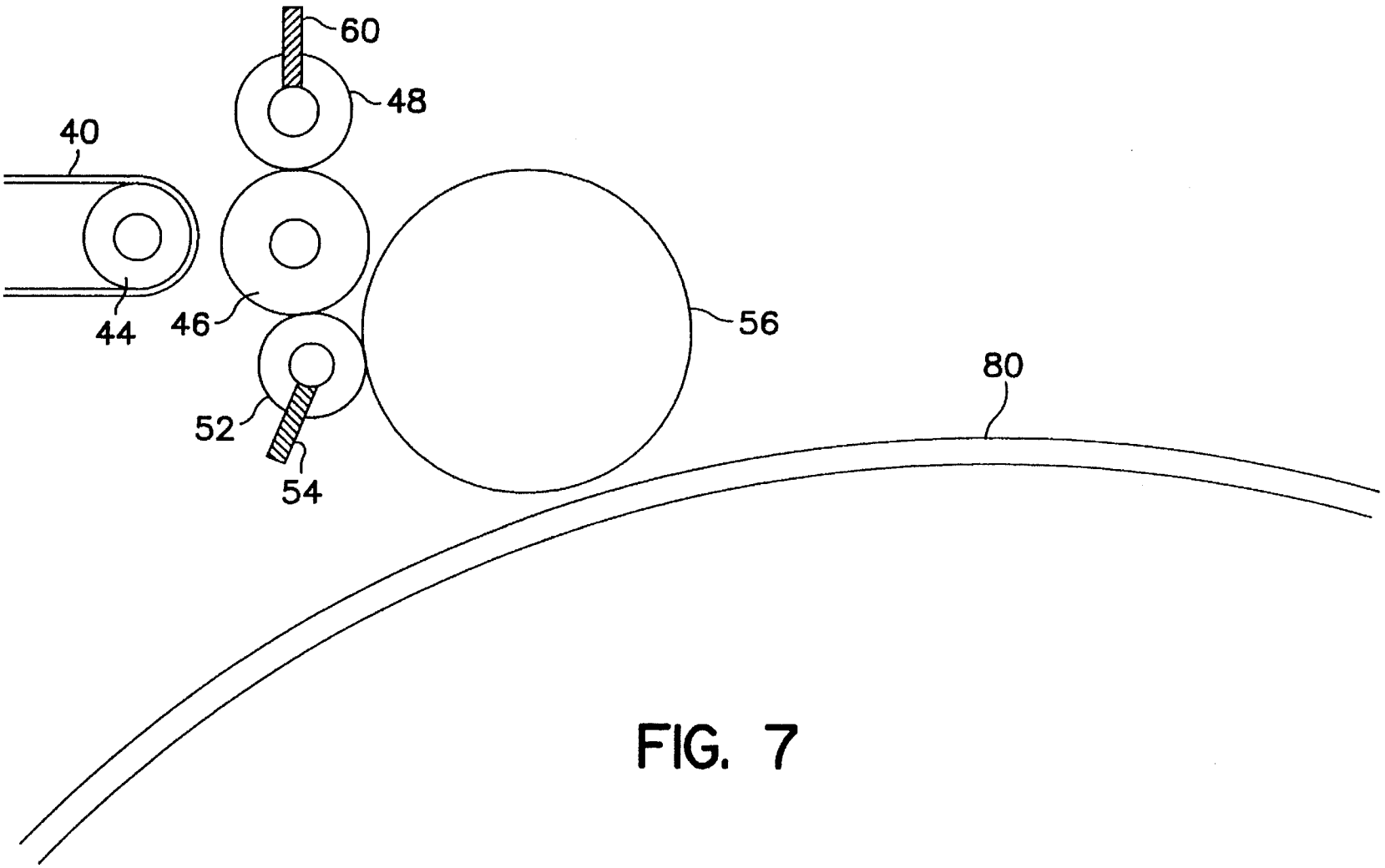
FIG. 7 is an enlarged, schematic view of the timing module of the disclosed embodiment of the invention.
Figure 9:
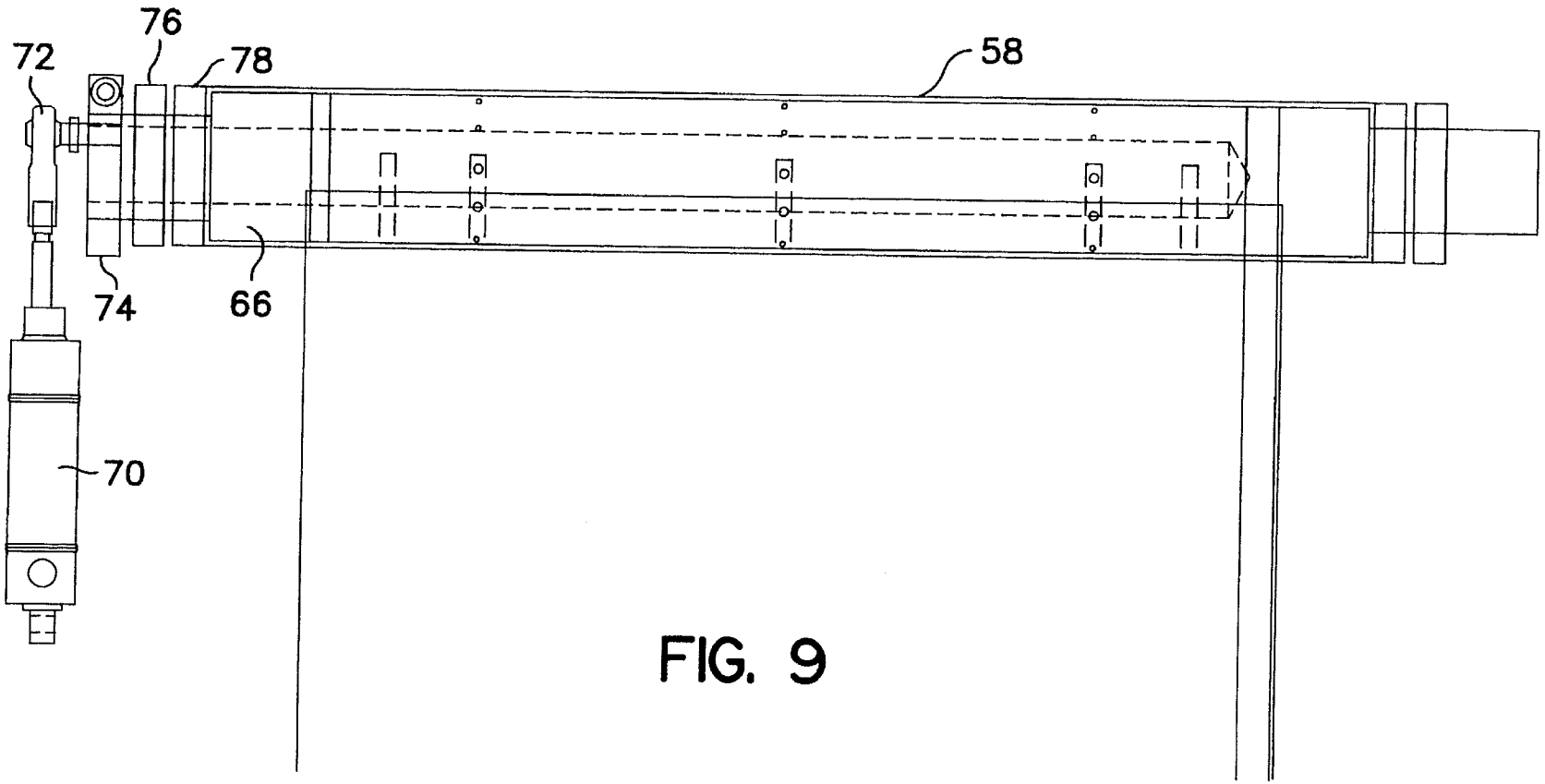
FIG. 9 is a side elevation view, taken transverse to FIG. 8, of the vacuum roller of the placement/bypass module.

The placement/bypass module, as may be seen from simultaneous consideration of FIGS. 8–10, comprises vacuum roller 58 which is in the form of a hollow porous cylinder 58 having a diameter which is adequately large to ensure against the inducement of a permanent curl to the documents being processed. The porous cylinder, journaled on both ends, is freely rotatable about a central hollow mandrel 66. The gap between the outer diameter of mandrel 66 and the inner diameter of roller 58 is very small and mandrel 66 is provided with an array of ports which, in the disclosed embodiment, are located in a single quadrant. Mandrel 66 is mounted so as to be capable of rotation, either clockwise or counter-clockwise, within roller 58. The drive for roller 58, as may be seen from FIG. 3, is driven by the same derived from belt 68 which drives the processing module transport drum 80. Belt 68 actually drives roller 56 (FIG. 7), the association between driven roller 56 and roller 58 having been omitted from the drawings in the interest of facilitating understanding of the invention. Thus cylinder 58 moves in synchronism with the processing module transport drum.

Means are provided to controllably impart rotation to mandrel 66 relative to roller 58. This control mechanism, upon command, can cause the mandrel 66 to rotate relative to the porous cylinder which comprises roller 58 through an angle of approximately 45°. Mandrel 66 is connected, by means not shown, to an adjustable vacuum source. Accordingly, a constant pressure is applied through the mandrel ports to the porous wall of roller 58 to induce air flow through the cylinder in the region thereof which is in registration with the ported quadrant of the mandrel. The control mechanism which may be employed to cause relative rotation between mandrel 66 and roller 58, to close off the vacuum in the upper quadrant of the porous cylinder which comprises roller 58, is shown in FIG. 9. This control mechanism includes a pneumatic actuator 70 having a piston rod connected to a pivot actuator 72. The pivot actuator is connected via an arm to a pivot clamp 74. Pivot clamp 74, in turn, is connected to mandrel 66. FIG. 9 also shows, at 76, the bearings on which mandrel 66 rotates and the bearings 78 on which the roller 58 rotates. When the mandrel is rotated relative to the porous outer cylinder to the position shown in FIG. 8, a received document will follow the linear path of its original trajectory and thus bypass the processing module. When, upon command which activates the pneumatic actuator 70, the mandrel 66 is repositioned, the leading edge of the incoming document will be intercepted and drawn downwardly against the porous cylinder 58 and rotated around the cylinder until the end of the quadrant of the mandrel is reached. This operation mode is represented in FIG. 10. At this point, the document will spring away from roller 58 but, in the manner to be described below, will attach itself to the transport drum 80 of the processing module.

The primary processing module includes a central transport module and multiple print heads. To first discuss the central transport module, this subsystem consists of a rotatably mounted cylinder or drum 80. Drum 80 is porous so that a document hold-down pressure differential may be created, i.e., air flow through the porous drum will result in a lower pressure on the interior than the exterior whereby incoming documents released from the placement/bypass module will be attracted to and held against the outer periphery of drum 80.

Figure 11:
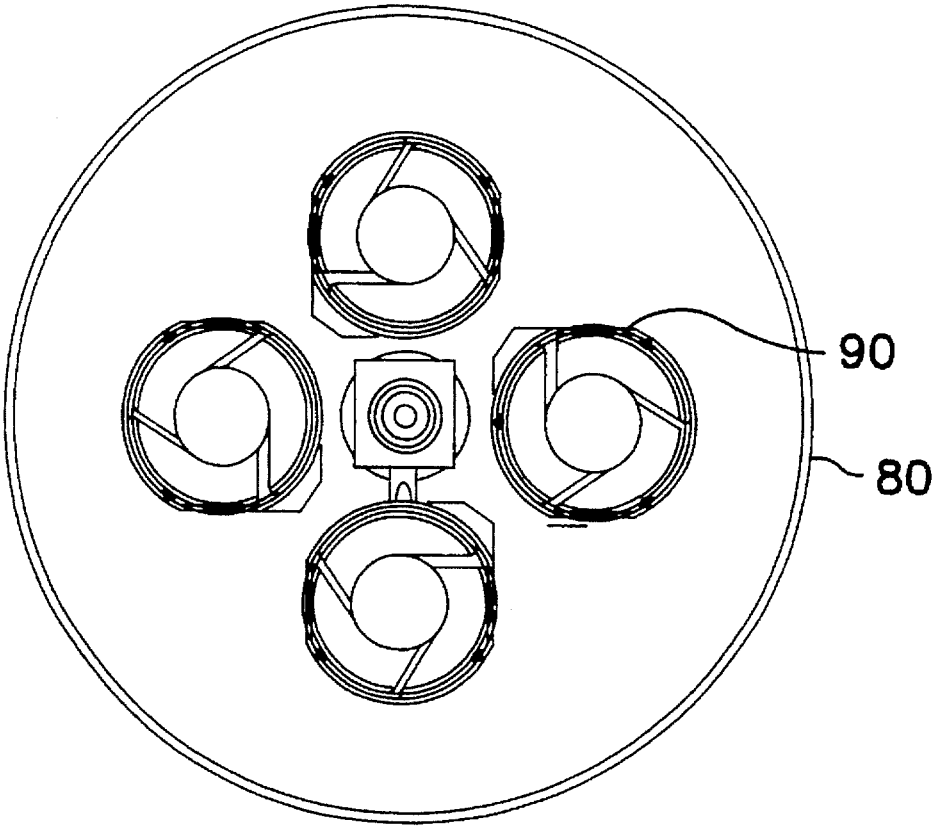
FIG. 11 is a schematic side elevation view of the drum of the transport system of the processing module of the disclosed embodiment.
Figure 12:
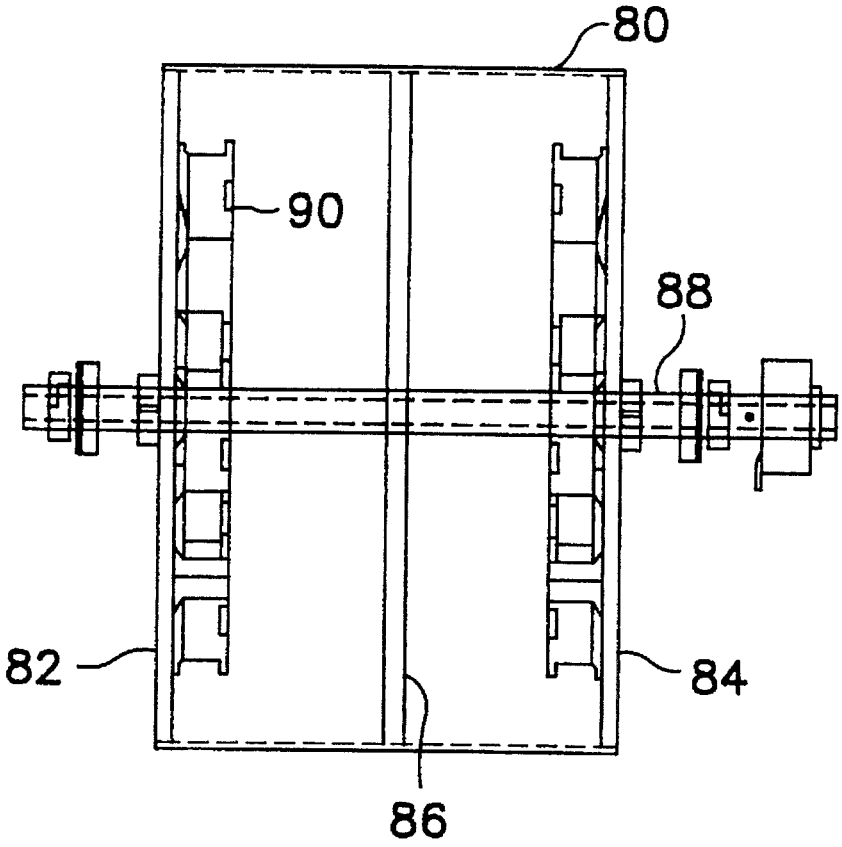
FIG. 12 is a view taken transverse to FIG. 11 showing the construction of the drum of the processing module transport.

The construction of the transport drum 80 may be seen from joint consideration of FIGS. 3, 11 and 12. The drum comprises a pair of end discs 82 and 84 and, if deemed necessary, an internal or central disc 86. A rigid "wrap" is supported by discs 82, 84 and 86, this rigid wrap defining the porous cylinder 80. The drum or cylinder 80 is mounted for rotation about a hollow axle 88, axle 88 thus defining the axis of rotation of the rotary transport. A plurality of fans 90 are supported on the end discs 82 and 84 of the rotary transport drum. The rotary transport drum is driven, via the main drive belt 68, by motor 92.

Proper performance of the disclosed embodiment of the invention requires that the documents being processed be flatly adhered to and transported with the rotating drum 80. Additionally, it is important that the periphery of drum 80, in addition to being uniformly porous, be electrically inert, non-expanding and capable of withstanding moderately high temperature changes without loss of concentricity.

The fans 90 mounted within drum 80 exhaust to the outside of the drum thus creating a controllable and constant low pressure environment within the drum. The pressure level within drum 80 must be sufficient to cause a single document to adhere to the surface of the drum while, at the same time, the vacuum level should not impede the removal of selected pages from the drum, in the manner to be described below, even when substantially the entire outer periphery of the drum is covered. The vacuum level within drum 80 may be controlled in numerous ways such as, for example, by exercising control over the speed of fans 90.

Axle 88 is journalled and mounted onto the frame of the apparatus. The hollow axle shaft 88 functions as a conduit through which power and control signals may be delivered to the components which are mounted within drum 80. The ends of axle shaft 88 which protrude beyond the machine frame are equipped with rotary unions and various auxiliary devices, such as encoders, drive pulleys, commutators, etc. to permit adequate control, monitoring and power delivery.

All of the document processing functions are performed radially within the processing module at points which are equidistant from the axis of axle 88. In the disclosed embodiment, the processing module includes eight print heads 94. In one reduction to practice of the invention, each print head comprised ninety-six ink jets, i.e., each print head was capable of printing ninety-six pixels at a time. Within each print head, the jets were spaced by a distance of eight pixels. The print heads 94 are mounted, in the manner to be described below, so as to be axially moveable. If the disclosed embodiment with eight printer heads is considered to be a two accent color printer, a document adhered to drum 80 would be caused to make two passes and the print heads would be stepped one pixel between passes. Each group of four print heads would be employed to print a different color and, of course, the print heads within each group would be axially offset from one another.

Figure 13:
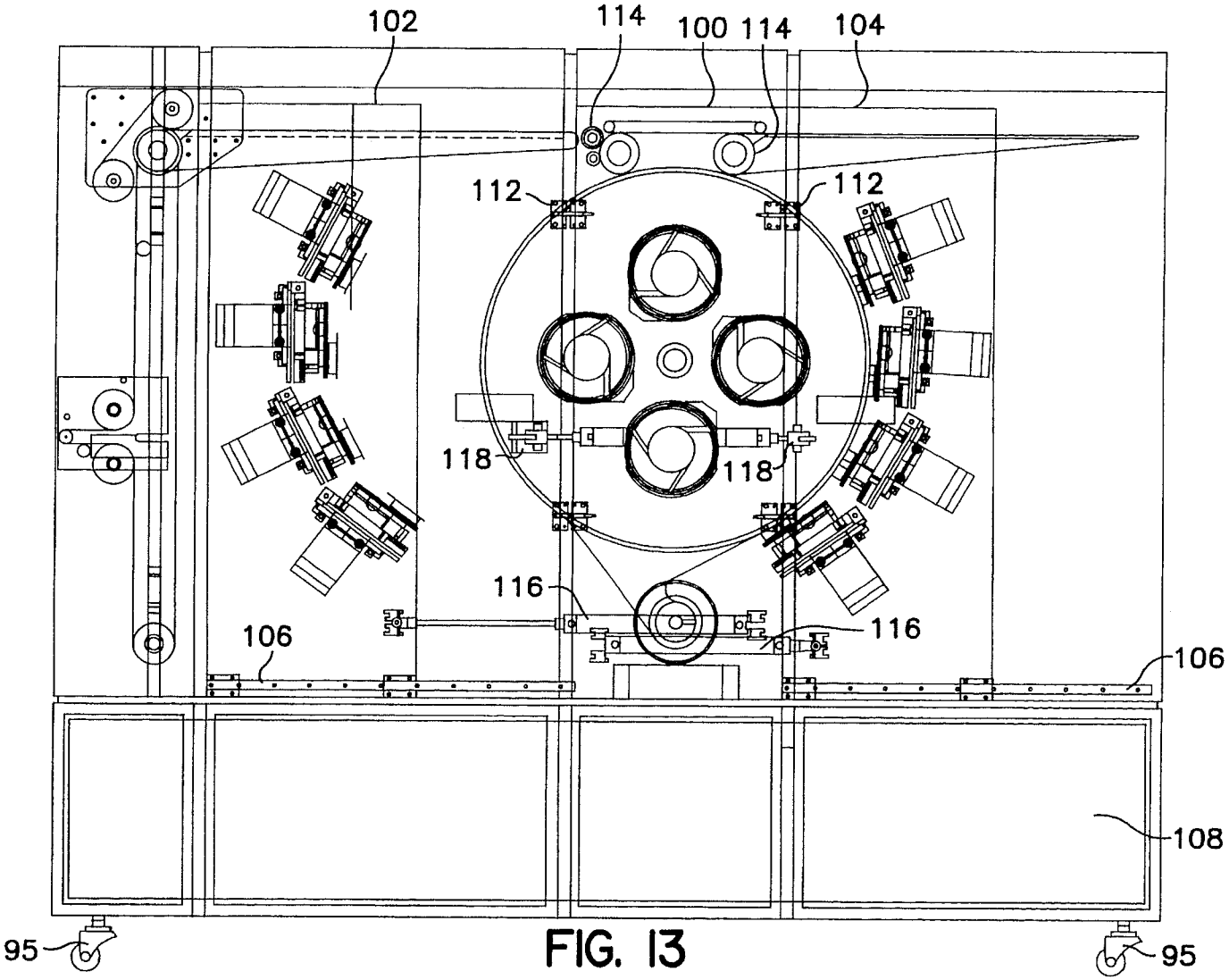
FIG. 13 is a partial schematic side elevation view of the apparatus of claim 2 wherein a frame section is extended.

In the interest of facilitating access to the printing heads for service, the machine frame of the apparatus in accordance with the disclosed embodiment of the invention is divided into separable modules whereby the print heads on either side of the drum 80 may be retracted from the drum. Thus, referring to FIG. 13, the central transport which includes drum 80 is mounted on a first or central "tower" 100 and the two arrays of four printing heads, which are located on opposite sides of a vertical plane through the axis of rotation of drum 80 are respectively mounted on second and third "towers" respectively indicated at 102 and 104. Since the spacing of the print heads from the outer periphery of the drum 80 is critical, the towers which carry the print heads are mounted on precision slides of guide rails 106, thus assuring the return of the print heads, after opening of the apparatus for service, to their exact original position. To further ensure the exact relative positioning of all components of the system, regardless of temperature variations and external conditions such as the state of the floor on which the apparatus is supported, the towers are mounted on a common rigid base 108 which is supported on leveling jacks or castors 95 as required.

The "towers" 102, 104 on which the print heads 94 are mounted have oppositely disposed side plates 106. One guide rails of each tower is mounted for movement along a guide rail 106. The other side plate of each tower travels on eccentrically mounted rollers. This arrangement permits lateral creep and adjustments. Precise docking is assured through the use of docking pins 112 which are guided into receivers 114 under the influence of pneumatic actuators 116. The towers which support the print heads are thus latched to the tower which supports drum 80 by means of pneumatic latches.

For the precise docking of the frame towers 102 and 104 to the central tower 100, a latching mechanism 118 is employed. The latching mechanism 118 has a first mount 120 fixed to the central tower 100 and a second mount 122 mounted to one of the slidable or moveable towers 102, 104. Fixed to mount 122 is a nipple 124. Fixed to mount 120 is a hydraulic cylinder 126 and two guide pins 128. Slidably mounted to the guide pins 128 is a collar 130.

Figure 14:
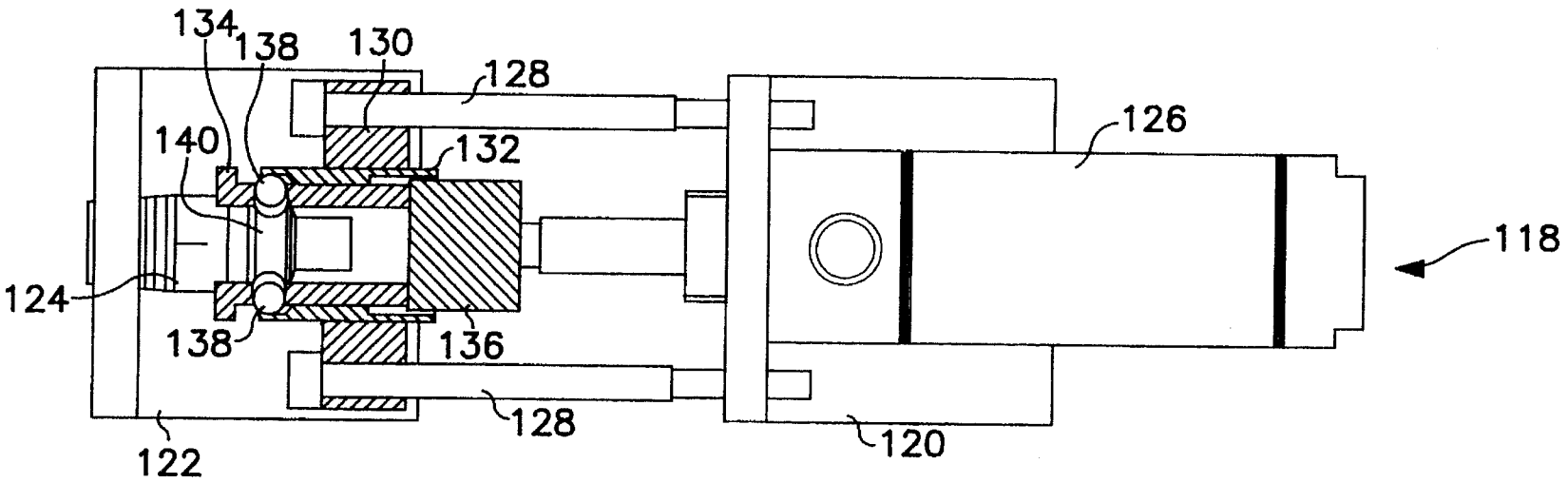
FIG. 14 is a partial schematic side view of the latching mechanism of FIG. 13 in an unlatched state.
Figure 15:
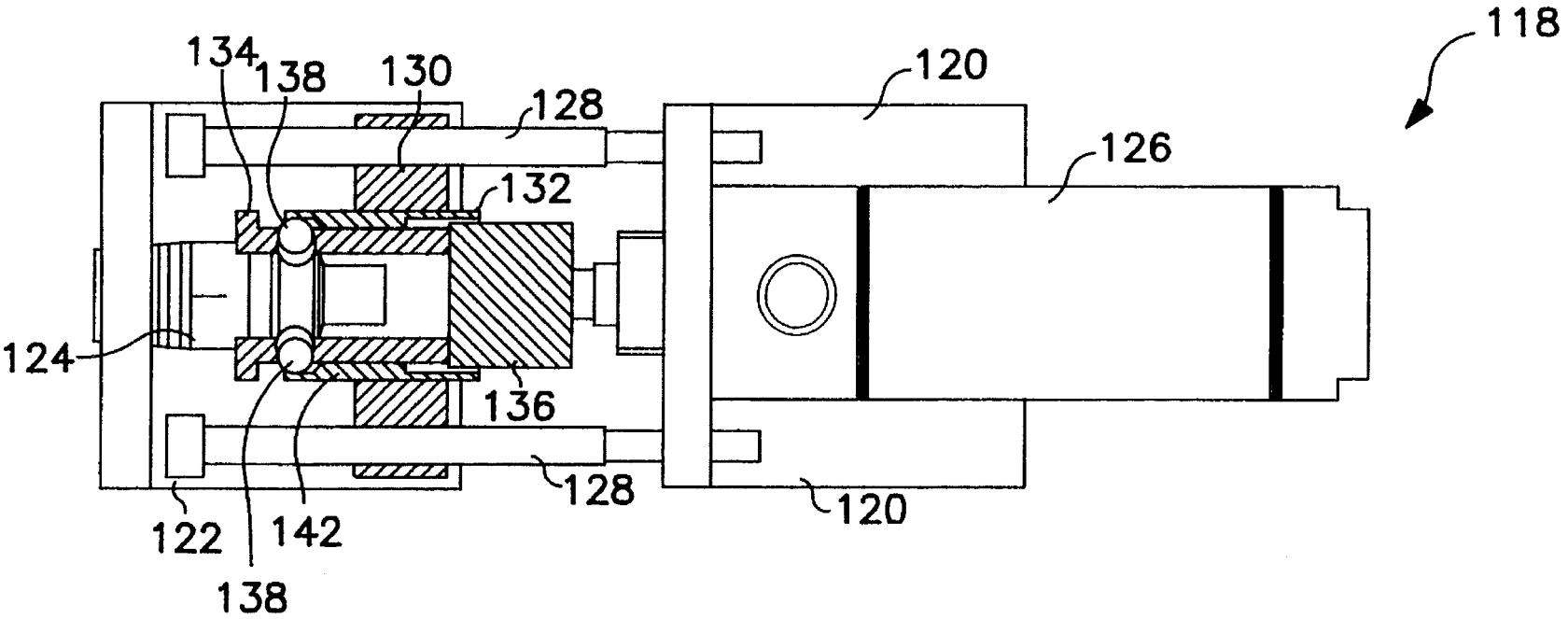
FIG. 15 is a partial schematic side view of the latching mechanism of FIG. 13 in a latched state.

FIG. 14 shows the nipple 124 beginning to engage with locking components 132. As shown in FIG. 14, the nipple engages shoulders on center sleeve 134 which is movably mounted to member 136. As mount 122 moves to mount 120, ball bearings 138 move into groove 140 on nipple 124. The ball bearings are held in position during the latching function in the groove by outer sleeve 142. Outer sleeve 142 is engaged by a spring, not shown, with member 136. Disengagement of the latching mechanism 118 is accomplished by the movement of sleeve 142 to allow the ball bearings 138 to rise out of the groove 140 of nipple 124 thereby allowing the nipple and mount 122 to be released.

The print heads 94 are, as noted above, mounted on individual platforms which are supported for movement on parallel tracks. Movement is imparted to these platforms, in response to the operation of stepping motors, by backlashless acme screws. The tracks on which the platforms travel are oriented parallel to the axis of axle 88 and the drive arrangement ensures positioning of the platforms with a precision of ⅛ pixel. To assure perfect alignment and spacing of the nozzle array of each print head from the surface of drum 80, each platform may be adjusted in three mutually orthogonal directions. Additionally, rotational adjustment about the axis of one of the jets of each print head is possible.

A pick-off module is located at the level of the vacuum roll of the placement/bypass module. The function of the pick-off module is to selectively remove documents from drum 80 and redirect the removed documents onto an exit conveyor. The construction of the pick-off module is similar to that of the placement/bypass module, i.e., the pick-off module includes a roller 58' which surrounds a mandrel 66'. The force exerted on a document which is adhered to drum 80 by the pick-off module must be sufficiently great, i.e., the level of vacuum within the mandrel 66' must be sufficiently low, to cause the document to be separated from drum 80. The mandrel 66' will be rotated, such that suction will be applied in the paper path defined by drum 80 only when it is desired to pick-off a document. Thus, through exercising control over the rotation of mandrel 66', a document may be maintained on drum 80 so as to make as many passes as necessary past the print heads.

A document picked off drum 80 by the pick-off module will be delivered to a discharge module comprising a series of horizontally oriented, elastomeric belts 96 which are driven in synchronism with the outer roller 58' of the pick-off module. The documents delivered to belts 96 will be held against the belts by spring fingers, such as finger 98, which function in the same manner as the fingers 42 of FIG. 5. The belts will deliver the document to a downstream location, i.e., to the subsequent processing module, which may be a stacker, shingling conveyor or other post processing equipment.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. An accent color printer comprising:

first conveyor means for the reception of documents from a first print system;

drum means for the reception of documents from said first conveyor means and support of documents on a rotatable drum;

print means disposed around said drum means for the addition of accent color to documents on said drum means; and second conveyor means for the reception of documents from said drum means.

2. The accent color printer of claim 1 wherein said print means comprises a plurality of radially positioned print heads around said drum means.

3. An accent color printer comprising:

a frame;

first conveyor means for the conveying of documents on said frame;

put down means for the putting down of documents from said first conveyor means to a drum means; drum means for the transporting of documents in a rotating path on a drum;

pick-up means for the picking up of documents from said drum means;

second conveyor means for conveying documents from said pick-up means; and print means disposed around said drum means for the printing of accent color on a document.

4. The accent color printer of claim 3 wherein said drum means further comprises vacuum means for the fixation of documents to said drum by a vacuum.

5. The accent color printer of claim 3 wherein said print means comprises a plurality of radially positioned print heads around said drum means.

6. The accent color printer of claim 4 wherein said vacuum means further comprise an air filter means for the filtration of air within the accent color printer.

7. The accent color printer of claim 4 wherein the vacuum means comprises a fan mounted within the drum to supply said vacuum.

8. The accent color printer of claim 4 wherein said vacuum means comprises a rotary internal vacuum mandrel.

9. The accent color printer of claim 3 wherein said put down means put down documents by use of a vacuum.

10. An accent color printer comprising;

a main printer body;

drum means for the holding of documents to be printed;

first frame means affixed to said main printer body for supporting said drum means;

second frame means slidably mounted to said main printer body for contact with said first frame means;

first printer means affixed to said second frame means for printing of accent color on documents supported by said drum means;

third frame means slidably mounted to said main printer body for contact with said first frame means; and second printer means affixed to said third frame means for the printing of accent color on documents supported by said drum means.

11. The accent color printer of claim 10 further comprising:

latching means for the latching of said second frame means to said first frame means.

12. The accent color printer of claim 11 wherein said latching means comprises a grooved nipple mounted to said second frame means and a pneumatic actuated capture means mounted to said first frame means.

13. Apparatus for adding color indicia to preprinted documents, said apparatus comprising:

in-feed means for receiving printed documents to which color indicia is to be added;

a document transport for moving said documents through a printing zone, said transport defining a transport path and having a curvilinear surface against which the printed documents are supported during the addition of color indicia thereto;

means establishing a pressure differential for holding documents on said curvilinear surface during movement thereof along said transport path;

printer means juxtapositioned to said curvilinear surface along said transport path, said printer means defining said printing zone and comprising plural print heads having ink jet for printing color indicia with wax based ink, said ink jets facings said curvillinear surface whereby ink may be selectively applied to documents moving through said printing zone on said transport path;

means for serially transferring received documents from said in-feed means to said transport; and out-feed means for removing documents from said transport after the addition of color indicia thereto.

14. The apparatus of claim 13 wherein said means for serially transferring documents comprises:

means for aligning received documents with said transport path prior to transfer thereof to said transport.

15. The apparatus of claim 14 wherein said means for serially transferring documents further comprises:

timing means for releasing documents from said means for aligning into said transport path, said timing means being positioned between said in-feed means and said aligning means, said timing means operating in response to command signals.

16. The apparatus of claim 15 wherein said printer means includes means for individually adjusting the position of said print heads relative to said transport path.

* * * * *